US005621914A

United States Patent [19]

Ramone et al.

[11] Patent Number: 5,621,914

[45] Date of Patent: Apr. 22, 1997

[54] PROTECTIVE GARMENT FOR SPORTS PARTICIPATION

[75] Inventors: Patrick J. Ramone, Hockessin; Paul M. Murphy, Wilmington, both of Del.

[73] Assignee: Hardcore Sports, Inc., Wilmington, Del.

[21] Appl. No.: 394,615

[22] Filed: Feb. 27, 1995

[51] Int. Cl.[6] ..... F41H 1/02

[52] U.S. Cl. ..... 2/463; 2/2.5; 2/92; 2/115

[58] Field of Search ..... 2/2, 2.5, 267, 92, 2/115, 113

[56] References Cited

U.S. PATENT DOCUMENTS

| | | | |
|---|---|---|---|
| 3,044,075 | 7/1962 | Rawlings | 2/267 X |
| 3,135,961 | 6/1964 | Roderick | 2/2 |
| 3,855,632 | 12/1974 | Davis | 2/2.5 |
| 4,100,620 | 7/1978 | Pecoraro | 2/102 |
| 4,370,754 | 2/1983 | Donzis | 2/2 |
| 4,397,636 | 8/1983 | Ganshaw | 2/2 X |
| 4,441,211 | 4/1984 | Donzis | 2/2 |
| 4,453,271 | 6/1984 | Donzis | 2/2 |
| 4,472,472 | 9/1984 | Schultz . | |
| 4,507,801 | 4/1985 | Kavanagh | 2/2 |
| 4,535,478 | 8/1985 | Züfle | 2/2.5 |
| 4,578,821 | 4/1986 | Zufle | 2/2.5 |
| 4,774,724 | 10/1988 | Sacks | 2/2.5 |
| 5,052,052 | 10/1991 | Gilford et al. | 2/267 X |
| 5,168,576 | 12/1992 | Krent et al. | 2/2 |
| 5,245,706 | 9/1993 | Moschetti et al. | 2/2 |
| 5,316,820 | 5/1994 | Harpell et al. . | |

*Primary Examiner*—Paul C. Lewis
*Attorney, Agent, or Firm*—Connolly & Hutz

[57] ABSTRACT

A protective garment minimizes injury to the wearer resulting from an impact to the general area of the heart. The garment is particularly adapted for use in sports participation such a little league baseball. The garment includes a shirt having a front side with a pocket on the inside of the shirt disposed in the general area of the heart. An impact resistant laminate is mounted in the pocket to shield the general area of the heart. The impact resistant laminate includes a protective flexible plate and a cushioning structure mounted in front of the plate.

9 Claims, 2 Drawing Sheets

PROTECTIVE GARMENT FOR SPORTS PARTICIPATION

BACKGROUND OF THE INVENTION

Various sports, such as baseball, involve the danger of injury by impact such as from a thrown or batted ball. This danger is particularly acute in little league play where fatalities have resulted from arrhythmia when the batter is struck by a pitched ball in the general area of the heart. One of the theories explaining the reason for the fatalities is that impact of the ball against the pulmonary sac occurs when the heart is between beats.

Although the fatalities occurring in little league play has received much publicity, the same danger is attendant for other types of sports. For example, impact from a field hockey stick could also result in fatalities as well as impact from any sport of activity involving high speed projectiles or a relatively great force being struck by any object such as a stick or club or bat during the participation of a sport or other activity.

SUMMARY OF THE INVENTION

An object of this invention is to provide a protective garment which reduces the possibility of fatality or other injury to the wearer.

A further object of this invention is to provide such a protective garment which would be particularly useful during sports activities involving high speed projectiles or swinging objects, such a clubs, sticks or bats.

In accordance with this invention the protective garment is a shirt which could be a tee-shirt, game jersey, sweatshirt, etc. wherein the shirt includes a front side having a portion disposed in the general area of the heart. An impact resistant member, preferably in plate form is mounted to the portion disposed in the general area of the heart. A cushioning structure is provided in front of the impact resistant member. The impact resistant member would disperse the impact force thereby protecting the user. The cushioning member would have the dual function of cushioning the degree of impact while also extending the time of impact so as to minimize the likelihood that the impact would be confined to the instant of time between heartbeats.

The invention may be practiced where the cushioning member is a foam layer mounted on the front side of the impact resistant plate. A second foam member may be mounted on the opposite side of the plate to thereby create an impact resistant sandwich laminate structure. The laminate may be mounted to the shirt by being inserted in a pocket. The pocket could be either permanently closed or openable by means, for example, of a flap so as to permit removal of the laminate when it is desired to clean the garment.

DETAILED DESCRIPTION

Figure 1:
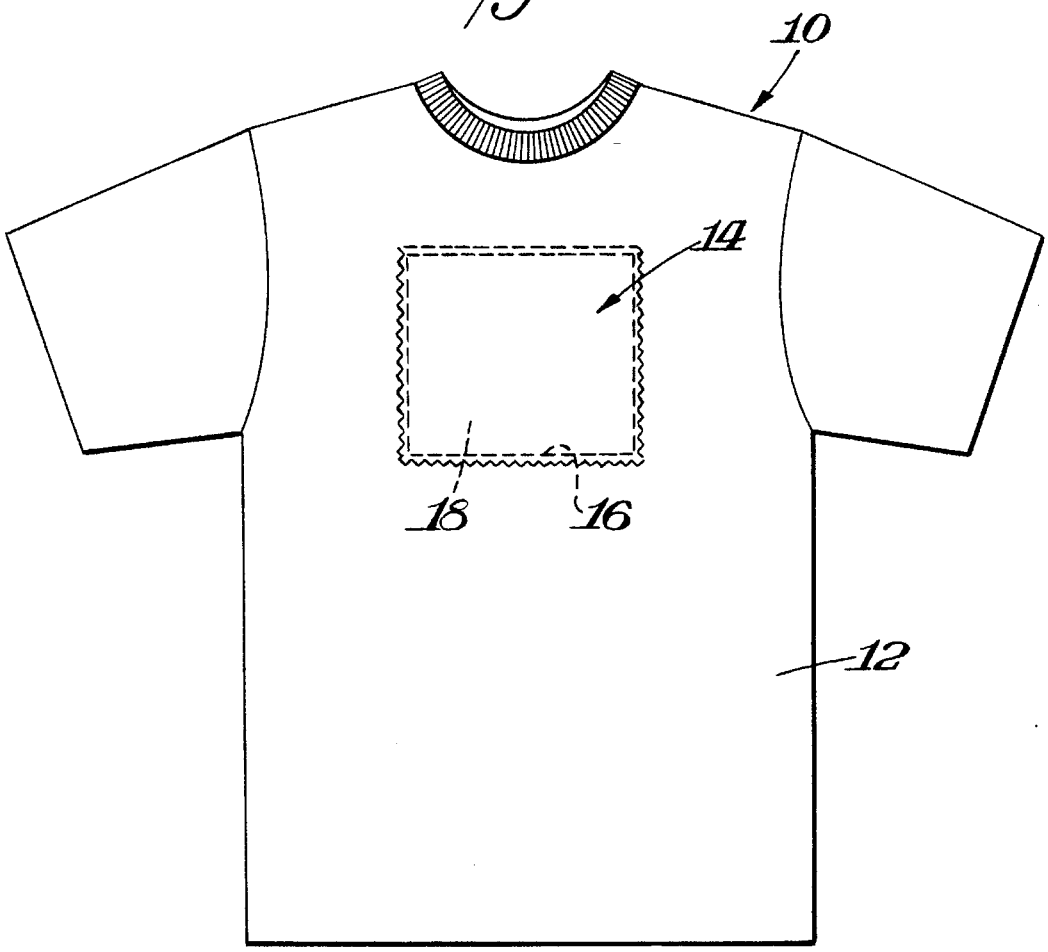
FIG. 1 is a front elevational view of a protective garment in accordance with this invention.

FIG. 1 illustrates a protective garment in accordance with this invention. As shown therein the garment is a shirt 10 which would be worn by the user. The term shirt is meant to generally include any type of garment that would have a front side 12 with a portion 14 generally located in the area of the heart. Such shirt could be a tee-shirt, game jersey, sweatshirt, turtleneck, sleeveless shirt, midriff shirt, etc. As with conventional shirts, shirt 10 is preferably made of a flexible fabric material.

In accordance with this invention a pocket 16 is formed in the heart portion of the shirt 12. Pocket 16 is utilized to mount an impact resistant laminate 18 in the general area of the heart in front of the pulmonary sac in the region of the sternum. The function of the impact resistant laminate 18 is to protect the wearer by distributing the impact force and by extending the time of impact over a sufficient period so that the time of impact would not be limited to being solely between heartbeats. As a result, by spreading the period of impact, arrhythmia should be avoided thereby minimizing the possibility of fatality or serious injury to the wearer.

Figure 2:
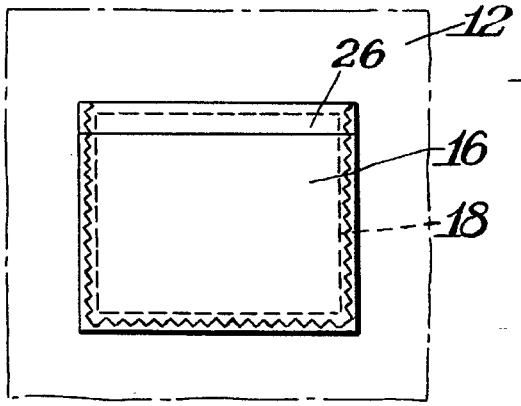
FIG. 2 is a fragmental rear elevation view of a pocket formed in the garment of FIG. 1.
Figure 3:
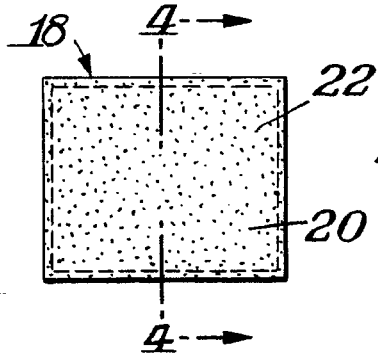
FIG. 3 is a front elevational view of the impact resistant laminate mounted in the pocket shown in FIGS. 1–2.
Figure 4:
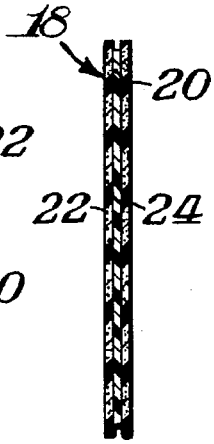
FIG. 4 is a cross-sectional view taken through FIG. 1 along the line 4—4.

FIGS. 3–4 illustrate the preferred form of impact resistant laminate 18. As shown therein a protective plate 20 is provided as the core member of the laminate 18. A cushioning member, preferably in the form of a foam layer, 22,24, is mounted on each side of the plate 20. The foam members 22,24 extend peripherally beyond the central plate 20 and the foam members are secured together along their periphery so as to sandwich the plate 20 between the foam layers 22,24. The resultant laminate 18 is inserted into pocket 16 as shown, for example, in FIG. 2. The laminate 18 may be permanently mounted in the pocket by completely closing the pocket as by stitching or other permanent closing means to assure that the impact resistant laminate will always be in the pocket. It is preferred, however, to have the pocket openable this has the advantage of permitting removal of the laminate 18 to permit the shirt 12 to be washed or otherwise cleaned and also to permit the shirt to be used as an ordinary garment when the user is not participating in a sports activity or other activity where protection is desired.

Pocket 16 may be opened by simply having the upper edge not secured to the remainder of the shirt 12 or by having a flap 26 which may tuck into the pocket 16.

Figure 5:
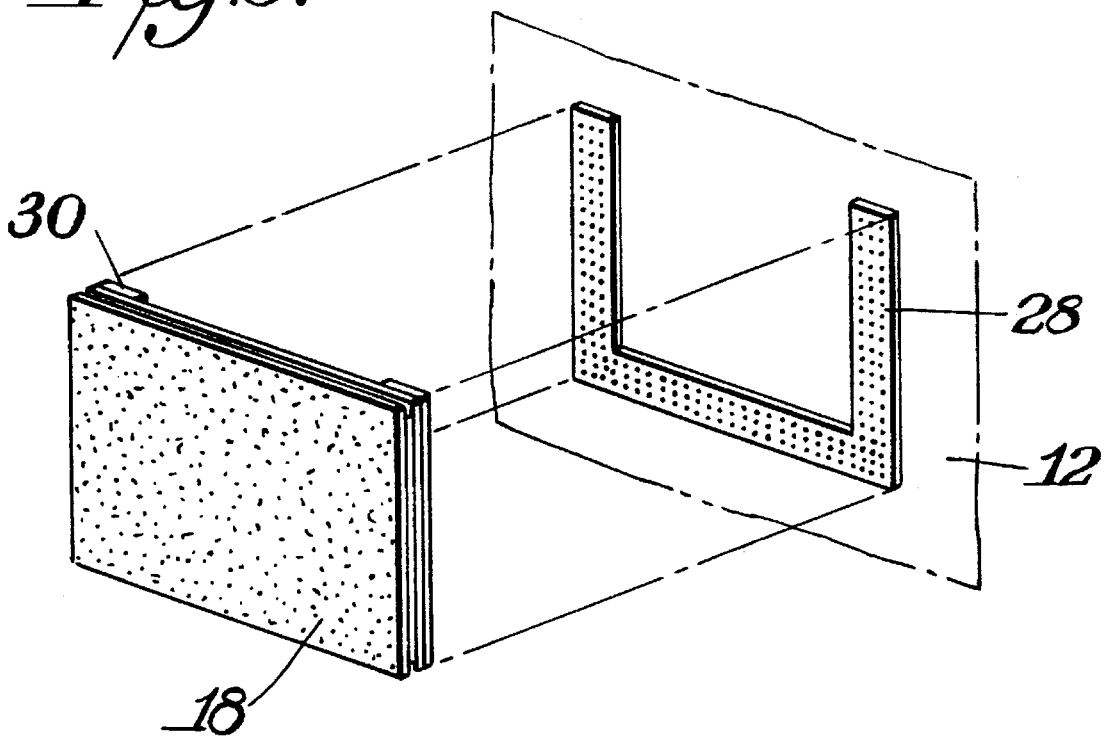
FIG. 5 is an exploded perspective view showing an alternative form of mounting the impact resistant laminate to a garment in accordance with this invention.

It is to be understood that any other means of mounting the laminate could be utilized in accordance with this invention. FIG. 5, for example, illustrates the front 12 of the shirt to include a base layer 28 which would be used for mounting the laminate 18 in any suitable manner. In the illustrated embodiment base layer 28 includes hook and loop fastener structure generally known as VELCRO which interacts with corresponding hook and loop fastener structure 30 on the laminate 18.

Any suitable materials may be used which provide the intended results of this invention. The central or core member 20 is preferably of a stiff yet slightly bendable plate material having sufficient impact resistance characteristics to distribute the force of an impact by minimizing penetration resulting from the impact. Conventional materials usable in bullet proof vests, for example, may be used for core member 20. Preferably, however, core member 20 is made from E-glass material formed as a composite from layers which include a core member having a fiberglass layer on each side thereof with resin impregnating the materials. Such composite material is a known material and the techniques for manufacturing such material are described in U.S. Pat. Nos. 5,316,462; 5,052,906; and 4,902,215, the details of which are incorporated herein by reference thereto. Other materials, such as KEVLAR (a registered Trademark of DuPont for man-made fibers for generalized use in industrial arts) may also be used. E-Glass is preferred since it is quite effective and less costly.

Any suitable foam materials may be used for layers 22,24. Preferably the foam is a washable foam. The function of outer foam layer 22 which is disposed remote from the wearer's body is to provide some cushioning of the impact force while lengthening the time of impact to minimize the sudden hit or impact possibly occurring between heartbeats. The functioning of the foam layer 24 which is disposed between the wearer's body and the core member is to provide added comfort.

If desired, the layer 24 could be omitted by making use of the material of shirt 10 itself to provide some of the comfort which layer 24 affords. Similarly, layer 22 could be omitted if the outer member of pocket 16 is formed of a material having the characteristics which are achieved by layer 22.

The placement of the impact resistant laminate is that it must cover the pulmonary sac in the general area of the sternum or heart. This could be slightly off center more to the left of the center line bisecting the front 12 of the shirt 10. If desired, however, the pocket 16 and thus the laminate 18 could be centered along the bisecting line provided that the laminate is of sufficient dimension to cover the desired area. Where the impact resistant laminate is worn off center it would be no more than ¼ inch to the left of the bisecting line. Each cushioning layer 22,24 is equal to or less than 1/16th inch thick and preferably about 1/32nd inch thick. The impact resistant laminate is preferably 7 inches by 7 inches so that it would provide the necessary protection for virtually all sizes of users.

A significant advantage of the present invention as compared, for example, to flak jackets is that flak jackets would be much more costly and too cumbersome to use during sports activities. In contrast with the present invention, the protection is limited to the general area of the heart and thereby minimizes the restriction of movement. As illustrated, the laminate 18 does not extend to other areas, such as the abdomen. In addition, because the present invention is significantly less costly it would lend itself to widespread use in amateur activities, particularly for little league play where cost is an important consideration.

Studies have shown that the response of a particle colliding with a stationary composite plate results in an indentation which is substantially less than that where there is no composite plate. The utilization of the composite plate in laminate 18 results in the force being distributed over the entire area of the plate rather than being confined to the point of impact.

The invention thus provides a garment which could be worn as a conventional garment during periods of activity where there is no need for protection from impacts and which could be worn as an impact resistant garment during such activities to minimize the likelihood of serious injury or fatality where there is impact in the general area of the heart. By confining the impact resistant laminate to only the area where it is needed, the restriction of movement of the wearer is minimized. This is achieved by adding little cost to the garment so as to make the use of such a garment practical for little league play and other areas where cost is of particular concern.

What is claimed is:

1. A protective garment for minimizing injury to the wearer as a result of impact to the general area of the heart for use in sports participation and the like comprising a shirt having a front side, said front side having a heart portion worn generally in front of the heart and having an abdomen portion, an impact resistant laminate mounted heart portion to shield the general area of the heart, said laminate comprising a protective plate and a cushioning structure mounted in front of said plate, said protective plate functioning as a means to disperse an impact force, and said cushioning structure functioning as a means to cushion the degree of impact from the impact force and to extend the time of impact for minimizing the likelihood that the impact would be confined to the instant of time between heartbeats, said cushioning structure being a layer of padding, a second layer of padding being provided on the side of said plate between said plate and the wearer's body and each of said layers of padding extending peripherally around said plate and being peripherally secured together to sandwich said plate therebetween.

2. The garment of claim 1 including a pocket formed on the inner surface of said shirt, and said impact resistant laminate being mounted in said pocket.

3. The garment of claim 2 wherein said pocket is closed completely around its periphery.

4. The garment of claim 2 wherein said pocket is closed along a major portion of its periphery and includes an open top.

5. The garment of claim 4 wherein said open top is closable by a flap.

6. The garment of claim 2 wherein said protective plate is formed from a stiff composite structure.

7. The garment of claim 6 wherein said composite structure includes a core layer with a fiberglass layer on each side thereof and containing a resin therethrough.

8. The garment of claim 2 wherein said shirt is a tee-shirt.

9. A protective garment for minimizing injury to the wearer as a result of impact to the general area of the heart for use in sports participation and the like comprising a shirt having a front side, said front side having a heart portion worn generally in front of the heart and having an abdomen portion, an impact resistant laminate mounted to said heart portion to shield the general area of the heart, said laminate comprising a protective plate and a cushioning structure mounted in front of said plate, said protective plate functioning as a means to disperse an impact force, said cushioning structure functioning as a means to cushion the degree of impact from the impact force and to extend the time of impact for minimizing the likelihood that the impact would be confined to the instant of time between heartbeats, said protective plate being formed from a stiff composite structure, and said composite structure including a core layer with a fiberglass layer on each side thereof and containing a resin therethrough.

* * * * *